US010596053B1

(12) United States Patent
Street

(10) Patent No.: US 10,596,053 B1
(45) Date of Patent: Mar. 24, 2020

(54) INFLATABLE ASSIST CHAIR

(71) Applicant: Jan Street, Temple, TX (US)

(72) Inventor: Jan Street, Temple, TX (US)

( * ) Notice: Subject to any disclaimer, the term of this patent is extended or adjusted under 35 U.S.C. 154(b) by 270 days.

(21) Appl. No.: 15/818,971

(22) Filed: Nov. 21, 2017

(51) Int. Cl.
*A61G 7/16* (2006.01)
*A61G 7/10* (2006.01)

(52) U.S. Cl.
CPC ..... *A61G 7/16* (2013.01); *A61G 7/1021* (2013.01)

(58) Field of Classification Search
CPC ..... A61G 7/16; A61G 7/1021; A61G 7/10; A47C 4/54; B60N 2/7082; B60N 2/914; B60C 29/00
USPC ..... 297/452.41; 5/655.3, 653, 654
See application file for complete search history.

(56) References Cited

U.S. PATENT DOCUMENTS 3,740,098 A * 6/1973 Lachnit ..... E02F 3/9212 299/8
5,345,630 A 9/1994 Healy
5,516,188 A * 5/1996 Bruhnke ..... B60N 2/286 297/129
5,742,957 A * 4/1998 Vanzant ..... A61G 5/14 297/DIG. 10
5,970,545 A 10/1999 Garman
6,042,186 A * 3/2000 Kojic ..... A47C 4/54 297/452.41
6,223,368 B1 5/2001 Anslin
7,360,266 B2 4/2008 Kasatshko
D568,085 S 5/2008 Pawsey
7,444,693 B2 11/2008 Russo
7,735,931 B1 * 6/2010 Weiner ..... A47C 4/54 297/188.04
8,783,781 B1 * 7/2014 McClure ..... A47C 4/54 297/452.41
9,901,177 B1 * 2/2018 Ulrich ..... A47C 4/54
2002/0133877 A1 * 9/2002 Kuiper ..... A61G 7/001 5/81.1 R
2007/0028388 A1 2/2007 Fletcher
2009/0085393 A1 * 4/2009 Austen ..... A47C 4/54 297/452.41

FOREIGN PATENT DOCUMENTS

WO 9637175 A 11/1996

* cited by examiner

*Primary Examiner* — Mark R Wendell
(74) *Attorney, Agent, or Firm* — Kyle A. Fletcher, Esq.

(57) ABSTRACT

The inflatable assist chair comprises a chair and a compressor. The chair may be inflated and deflated using the compressor to more air into and out of the chair. The deflated chair may be placed next to a supine person and the supine person may be moved onto the deflated chair. The compressor may then be activated to inflate the chair, lifting the supine person off the ground and eventually into a seated position. Once the occupant of the chair has been moved to a wheelchair or o a standing position, the direction of airflow through the compress may be reversed an the compressor may be used to deflate the chair. In some embodiments, support ridges on the side of the chair may prevent the supine person form rolling off of the chair as it inflates.

16 Claims, 7 Drawing Sheets

INFLATABLE ASSIST CHAIR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of home health care, more specifically, an inflatable assist chair.

SUMMARY OF INVENTION

The inflatable assist chair comprises a chair and a compressor. The chair may be inflated and deflated using the compressor to more air into and out of the chair. The deflated chair may be placed next to a supine person and the supine person may be moved onto the deflated chair. The compressor may then be activated to inflate the chair, lifting the supine person off the ground and eventually into a seated position. Once the occupant of the chair has been moved to a wheelchair or o a standing position, the direction of airflow through the compress may be reversed and the compressor may be used to deflate the chair. In some embodiments, support ridges on the side of the chair may prevent the supine person form rolling off of the chair as it inflates.

An object of the invention is to provide an inflatable chair that can lift a supine person to a seated position.

Another object of the invention is to provide a chair comprising an air compressor to inflate and deflate the chair.

A further object of the invention is to provide side support ridges on the inflatable chair to prevent the supine person from rolling off of the chair as it inflates.

Yet another object of the invention is to provide an inflatable chair, which can be folded to reside within an outer shell and transported using a carrying handle.

These together with additional objects, features and advantages of the inflatable assist chair will be readily apparent to those of ordinary skill in the art upon reading the following detailed description of the presently preferred, but nonetheless illustrative, embodiments when taken in conjunction with the accompanying drawings.

In this respect, before explaining the current embodiments of the inflatable assist chair in detail, it is to be understood that the inflatable assist chair is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the inflatable assist chair.

It is therefore important that the claims be regarded as including such equivalent construction insofar as they do not depart from the spirit and scope of the inflatable assist chair.

It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
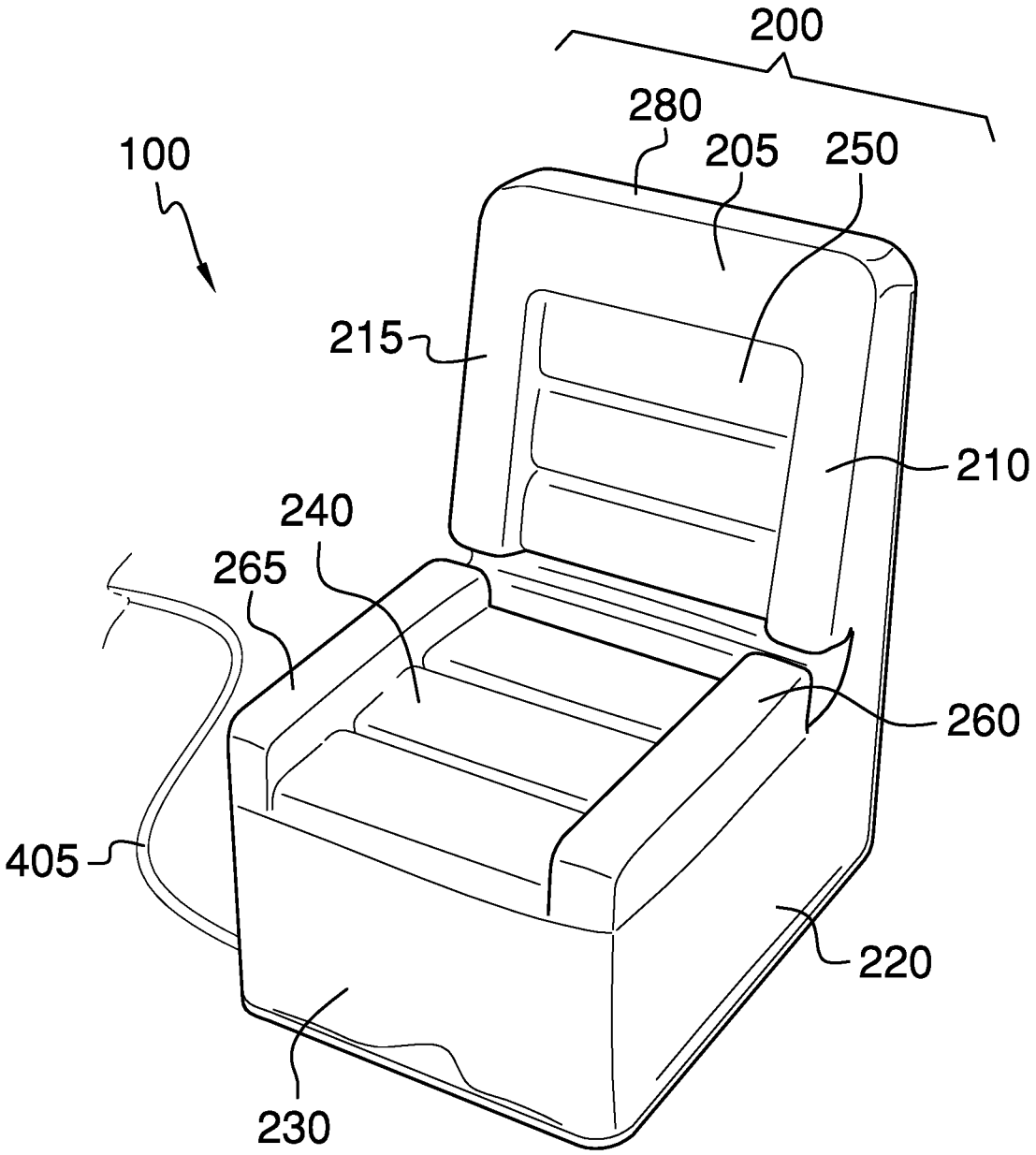
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Detailed reference will now be made to a first potential embodiment of the disclosure, which is illustrated in FIGS. 1 through 7.

The inflatable assist chair 100 (hereinafter invention) comprises a chair 200 and a compressor 400. The chair 200 may be inflated using the compressor 400 to form an inflated chair 110 or deflated using the compressor 400 to form a deflated chair 120. The deflated chair 120 may be placed under a supine person 900. The supine person 900 may be elevated and repositioned into a seated position 910 when the inflated chair 110 is fully formed.

Throughout this disclosure, directional terms assume the point of reference of an occupant of the chair 200. Specifically, left and right are defined by the left and right side of a person in the seated position 910 on the inflated chair 110. Rear and front comprise areas that are behind and in front of this person, respectively. Up and down direct to areas that are above or below this person, respectively.

The chair 200 comprises a rear side 275, a bottom 270, a top 280, a front side 230, a seat back 250, a seat 240, a left side 220, and a right side 225. The chair 200 may be an airtight container that may be inflated and deflated. When inflated, the chair 200 may expand and change shape to form the inflated chair 110. When deflated, the chair 200 may contract and change shape to form the deflated chair 120.

The rear side 275 may be a rectangular outer covering on the rear side of the inflated chair 110. The rear side 275 is defined by a first edge 601, a second edge 602, a third edge 603, and a fourth edge 604.

The bottom 270 may be a rectangular outer covering on the underside of the inflated chair 110. The bottom 270 is defined by a fifth edge 605, a sixth edge 606, a seventh edge 607, and an eighth edge 608.

The top 280 may be a rectangular outer covering on the top side of the inflated chair 110. The top 280 is defined by a ninth edge 609, a tenth edge 610, an eleventh edge 611, and a twelfth edge 612.

The front side 230 may be a rectangular outer covering on the underside of the inflated chair 110. The front side 230 is defined by a thirteenth edge 613, a fourteenth edge 614, a fifteenth edge 615, and a sixteenth edge 616.

The seat 240 may be a rectangular outer covering on the underside of the inflated chair 110. The seat 240 is defined by a twenty-first edge 621, a twenty-second edge 622, a twenty-third edge 623, and a twenty-fourth edge 624.

The left side 220 may be an L-shaped outer covering of the chair 200 located on the left side of the chair. The left side 220 is defined by a twenty-fifth edge 625, a twenty-sixth edge 626, a twenty-seventh edge 627, a twenty-eighth edge 628, a twenty-ninth edge 629, and a thirtieth edge 630.

The right side 225 may be an L-shaped outer covering of the chair 200 located on the right side of the chair. The right side 225 is defined by a thirty-first edge 631, a thirty-second edge 632, a thirty-third edge 633, a thirty-fourth edge 634, a thirty-fifth edge 635, and a thirty-sixth edge 636.

The outer coverings comprising the chair 200 are coupled at airtight seams. Specifically, The first edge 601 on the rear side 275 is coupled to the eleventh edge 611 on the top 280. The second edge 602 on the rear side 275 is coupled to the thirtieth edge 630 on the left side 220. The third edge 603 on the rear side 275 is coupled to the fifth edge 605 on the bottom 270. The fourth edge 604 on the rear side 275 is coupled to the thirty-sixth edge 636 on the right side 225.

The sixth edge 606 on the bottom 270 is coupled to the twenty-ninth edge 629 on the left side 220. The seventh edge 607 on the bottom 270 is coupled to the thirteenth edge 613 on the front side 230. The eighth edge 608 on the bottom 270 is coupled to the thirty-fifth edge 635 on the right side 225.

The ninth edge 609 on the top 280 is coupled to the twenty-third edge 623 on the seat back 250. The tenth edge 610 on the top 280 is coupled to the twenty-fifth edge 625 on the left side 220. The twelfth edge 612 on the top 280 is coupled to the thirty-first edge 631 on the right side 225.

The fourteenth edge 614 on the front side 230 is coupled to the twenty-eighth edge 628 on the left side 220. The fifteenth edge 615 on the front side 230 is coupled to a seventeenth edge 617 on the seat 240. The sixteenth edge 616 on the front side 230 is coupled to the thirty-fourth edge 634 on the right side 225.

An eighteenth edge 618 on the seat 240 is coupled to the twenty-seventh edge 627 on the left side 220. A nineteenth edge 619 on the seat 240 is coupled to the twenty-first edge 621 on the seat back 250. A twentieth edge 620 on the seat 240 is coupled to the thirty-third edge 633 on the right side 225.

The twenty-second edge 622 on the seat back 250 is coupled to the twenty-sixth edge 626 on the left side 220. The twenty-fourth edge 624 on the seat back 250 is coupled to the thirty-second edge 632 on the right side 225.

Figure 6:
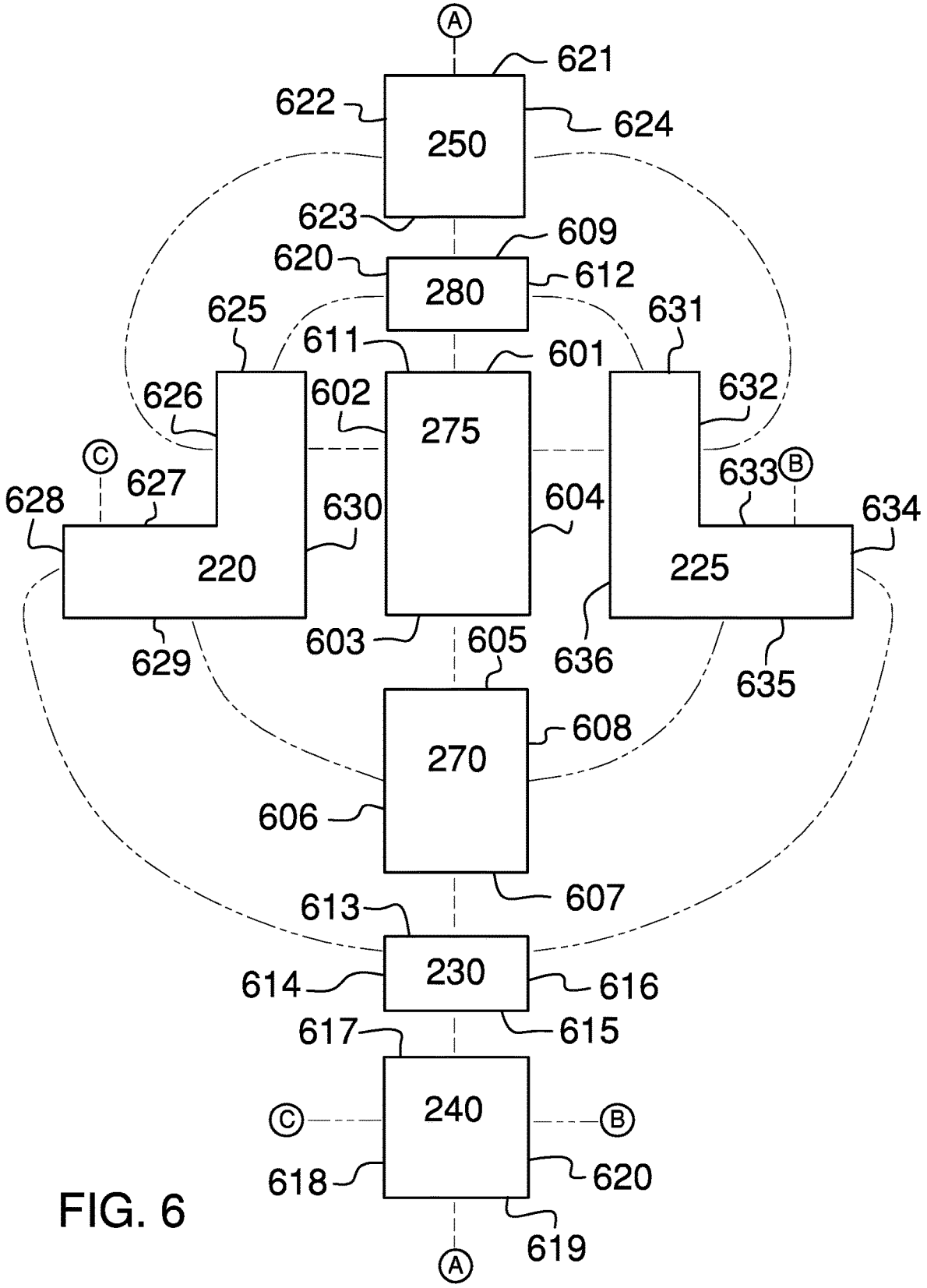
FIG. 6 is an exploded view of an embodiment of the disclosure illustrating side panels of the chair and their edge interconnections.
Figure 7:
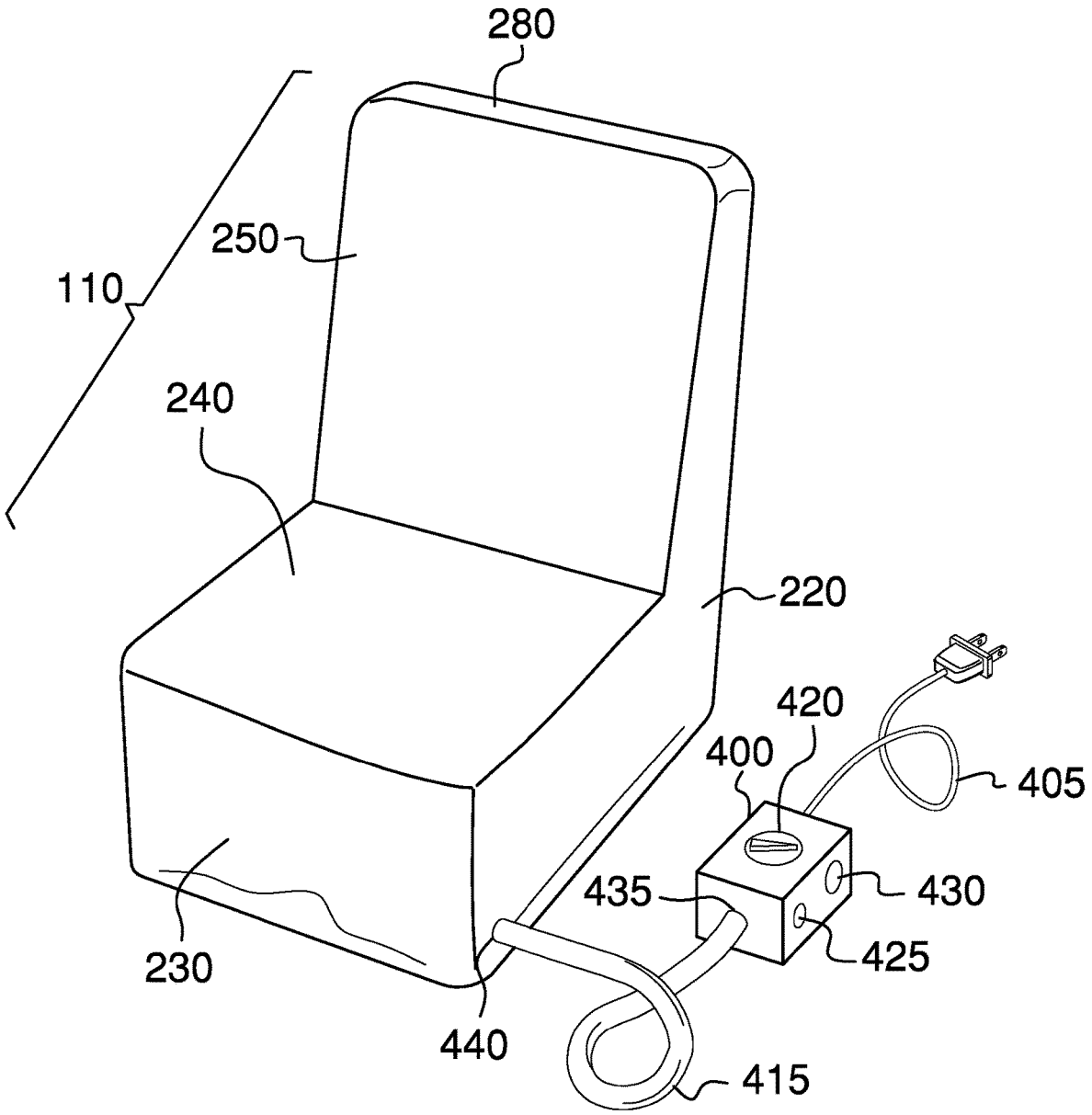
FIG. 7 is a perspective view of an embodiment of the disclosure illustrating an external compressor and no side support ridges.

FIG. 6 shows an exploded view of these elements and indicates their edge interconnections. FIG. 7 illustrates the chair 200 formed from these interconnected elements.

The compressor 400 comprises an air pump 410, an electric motor 445, and a motor control 425. The air pump 410 may move air 920 into or out of the chair 200 when turned by the electric motor 445. The electric motor 445 may be energized by the application of electrical power from a power cord 405 or from one or more batteries 450. The compressor 400 may move the air 920 from an inlet 430 of the compressor 400 to an outlet 435 of the compressor 400 when the motor control 425 is in an on position and may prevent the flow of the air 920 though the compressor 400 when the motor control 425 is in an off position. The inlet 430 may be coupled to ambient air outside of the chair 200 and the outlet 435 may be coupled to the interior of the chair 200. When the compressor 400 is activated it may increase the pressure inside of the chair 200, causing the deflated chair to expand and form the inflated chair 110.

The compressor 400 may further comprise a reversing control 420. The compressor 400 may reverse the flow of the air 920 through the air pump 410, causing the air 920 to move from the outlet 435 to the inlet 430.

In some embodiments, the reversing control 420 may be mechanical in nature. As a non-limiting example, the inlet 430 may mechanically reroute the air 920 through the compressor 400 to reverse the flow.

In some embodiments, the reversing control 420 may be electrical in nature. As a non-limiting example, the reversing control 420 may reverse the electrical connections to the air pump 410, causing it to move the air 920 in the opposite direction.

In some embodiments, the compressor 400 may be located inside of the chair 200 and may be coupled to the bottom 270 on the interior of the chair 200.

Figure 2:
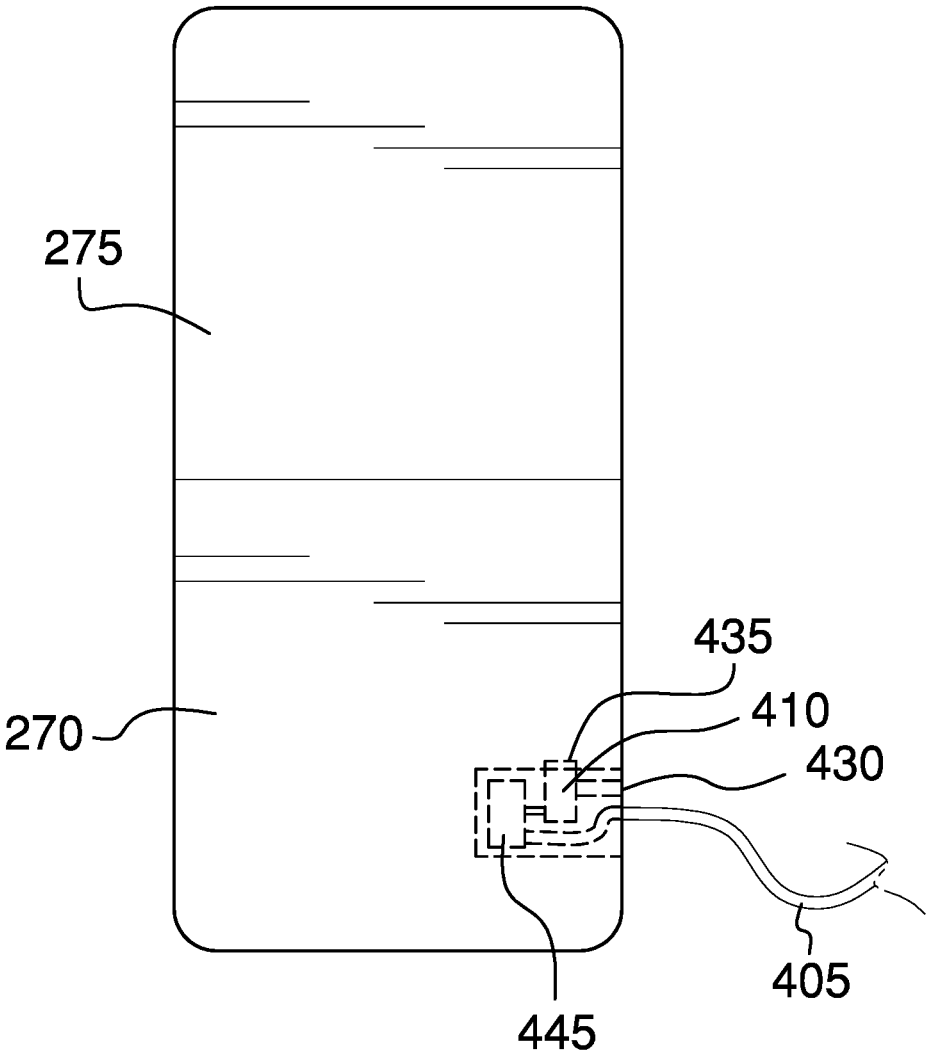
FIG. 2 is a bottom view of an embodiment of the disclosure when deflated.
Figure 3:
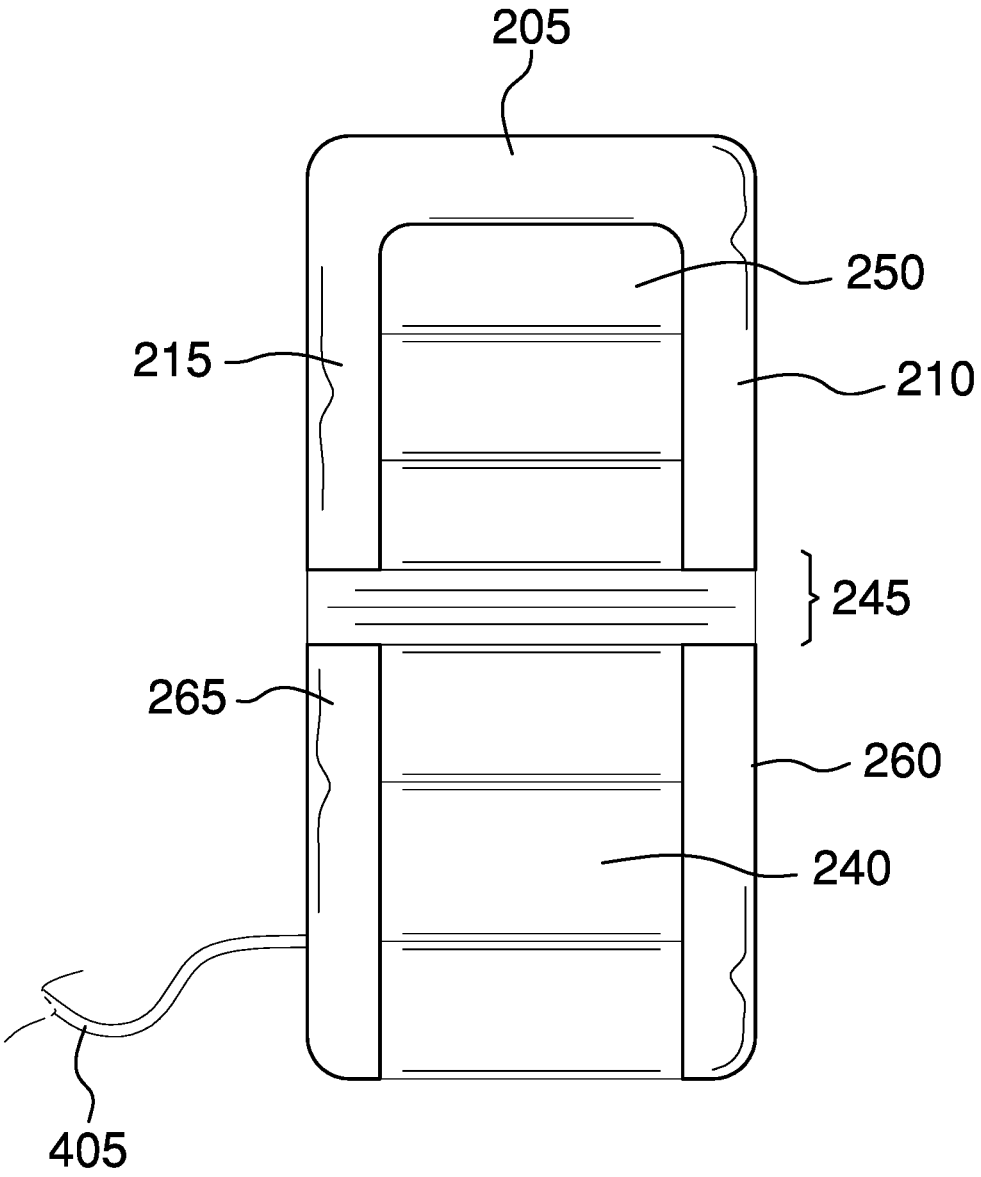
FIG. 3 is a top view of an embodiment of the disclosure when deflated.
Figure 4:
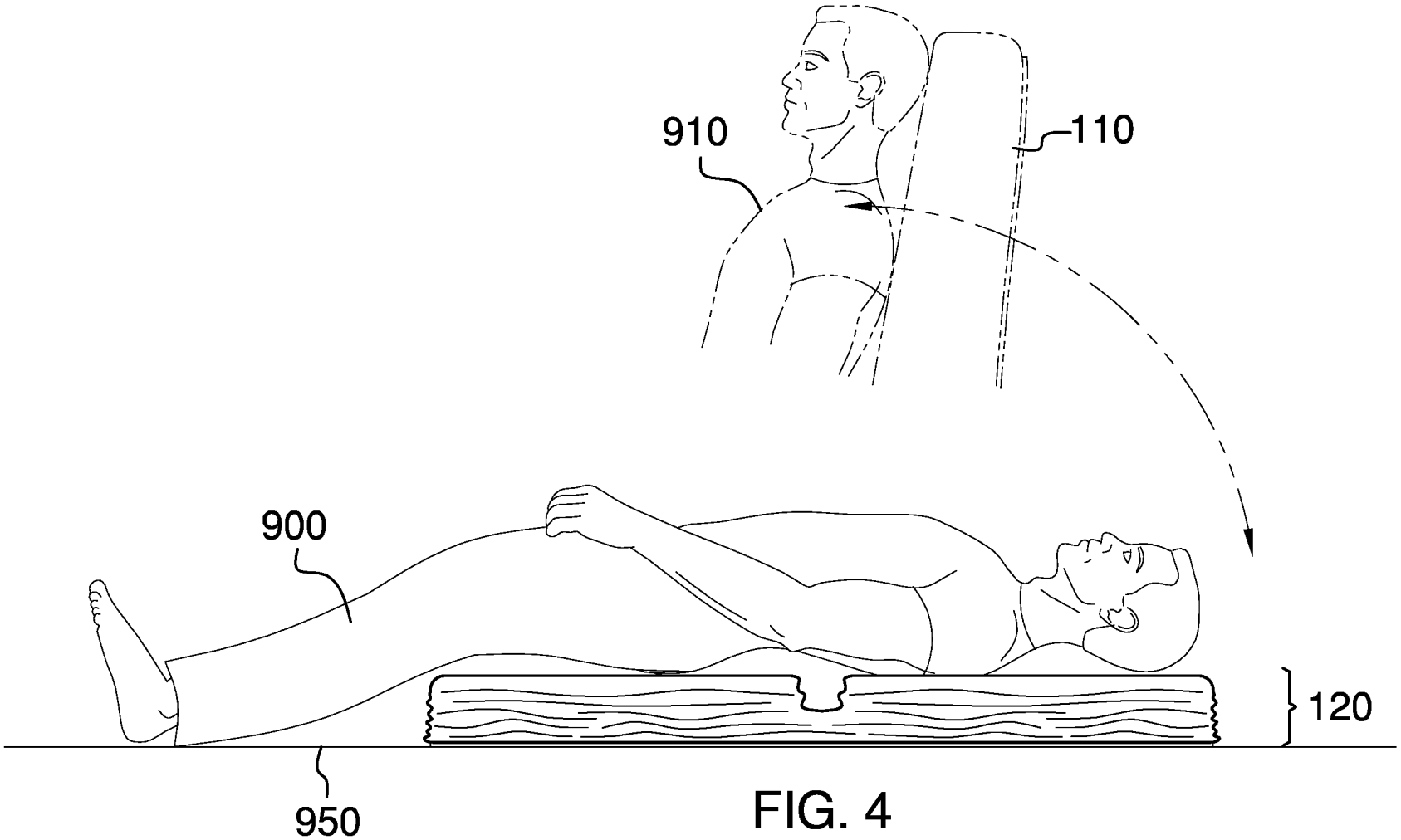
FIG. 4 is an in-use view of an embodiment of the disclosure illustrating a supine person being lifted into a seated position.
Figure 5:
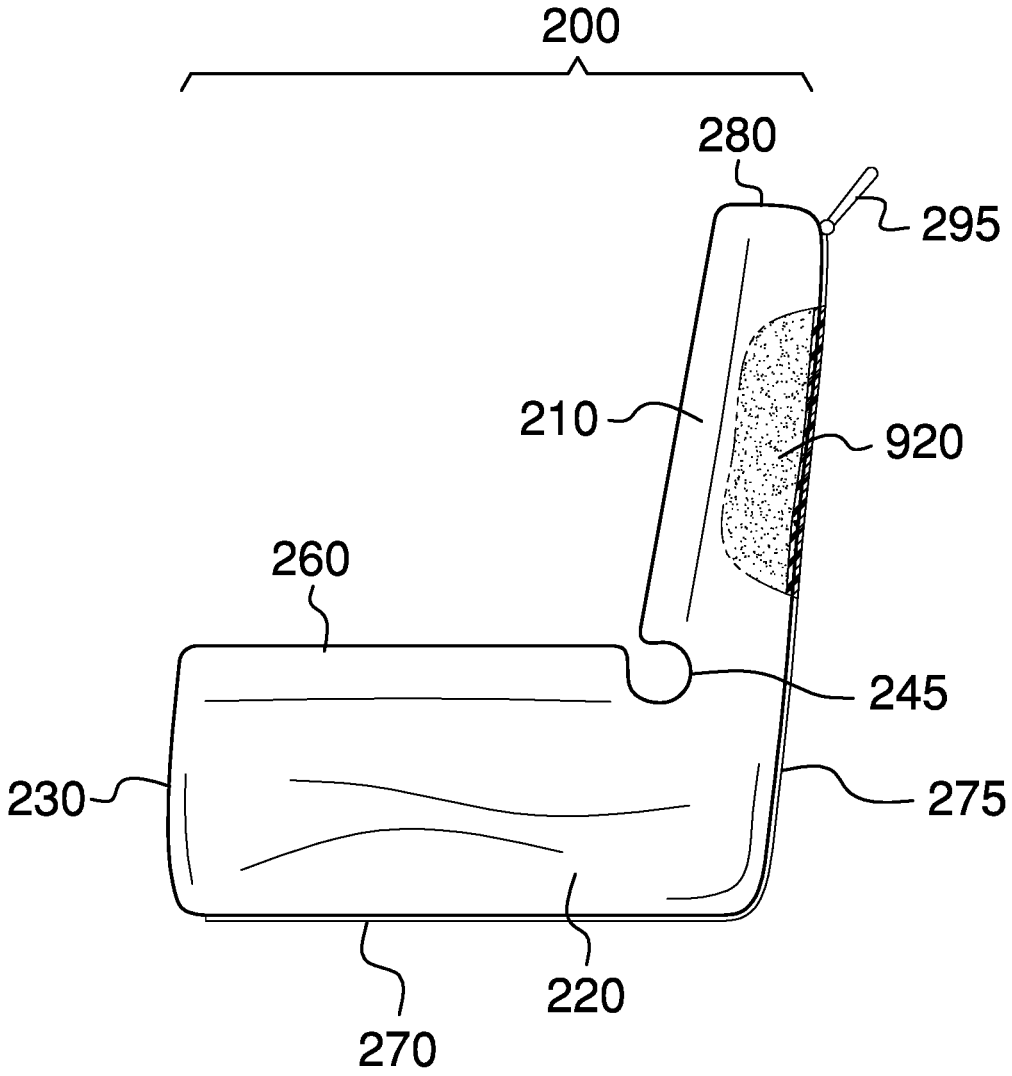
FIG. 5 is a left side view of an embodiment of the disclosure illustrating a detail of the inside.

In these embodiments, the inlet 430 may be coupled to the left side 220, the right side 225, the front side 230, or the rear side 275 and the outlet 435 may be located within the interior space of the chair 200. FIG. 2 illustrates the compressor 400 located within the chair 200.

In some embodiments, the compressor 400 may be located outside of the chair 200.

In these embodiments, the outlet 435 may be coupled to the chair 200 via an air hose 415 that runs between the outlet 435 and the left side 220, the right side 225, the front side 230, or the rear side 275. The air hose 415 may couple to an air hose coupler 440 on the chair 200. FIG. 7 illustrates the compressor 400 located outside of the chair 200.

The chair 200 may be fabricated from a flexible, airtight material. As non-limiting examples, the chair 200 may be fabricated from vinyl or plastic.

In some embodiments, the bottom 270 and the rear side 275 may be made from a different material than other parts of the chair 200, because they make contact with the ground 950. As non-limiting examples, the bottom 270 and the rear side 275 may be a heavier grade of plastic than the rest of the chair 200 or the bottom 270 and the rear side 275 may be plastic when the rest of the chair 200 is vinyl.

In some embodiments, the chair 200 may comprise an internal structure (not illustrated in the figures) to retain the shape of the inflated chair 110. As non-limiting examples, the internal structure may comprise internal partial walls or straps running from side-to-side, front-to-back, and/or top-to-bottom. The internal structure may prevent walls of the chair 200 from expanding beyond dimensions established by the internal structure.

The deflated chair 120 may be transported by folding the deflated chair 120 in half at the boundary between the rear side 275 and the bottom 270 so that the rear side 275 and the bottom 270 form a protective shell for all other surfaces of the chair 200, which may be tucked between them.

In some embodiments, the invention 100 may comprise a handle 295 for ease in carrying the deflated chair 120 when folded.

In some embodiments, the invention 100 may comprise elevated side ridges to prevent the supine person 900 from rolling off the chair 200 as it is inflated. Specifically, the chair 200 may comprise a left support ridge 260 and a right support ridge 265. Because of the weight of the supine person 900 on the seat 240 and the seat back 250 but not on the left support ridge 260 and the right support ridge 265, the left support ridge 260 and the right support ridge 265 may be among the first parts of the chair 200 to inflate. When inflated, they form barriers on either side of the supine person 900. The left support ridge 260 may comprise an elevated area of the seat 240 on the left side of the chair 200. The right support ridge 265 may comprise an elevated area of the seat 240 on the right side of the chair 200. The left support ridge 260 and the right support ridge 265 may be oriented to run from front to rear of the inflated chair 110. The left support ridge 260 and the right support ridge 265 may each be less than 6 inches wide. When inflated, the left support ridge 260 and the right support ridge 265 may be elevated between 1 inch and 6 inches above the plane of the seat 240.

In some embodiments, the invention 100 may comprise an upper left support ridge 210 and an upper right support ridge 215. The upper left support ridge 210 and the upper right support ridge 215 function in the same manner as the left support ridge 260 and the right support ridge 265 except for being located along the torso of the supine person 900.

The upper left support ridge 210 may comprise an elevated area of the seat back 250 on the left side of the chair 200. The upper right support ridge 215 may comprise an elevated area of the seat back 250 on the right side of the chair 200. The upper left support ridge 210 and the upper right support ridge 215 may be oriented to run from top to bottom of the inflated chair 110. The upper left support ridge 210 and the upper right support ridge 215 may each be less than 6 inches wide. When inflated, the upper left support ridge 210 and the upper right support ridge 215 may extend between 1 inch and 6 inches in front of the plane of the seat back 250.

The left support ridge 260 and the upper left support ridge 210 may be spaced to allow for pivoting of the upper left support ridge 210 towards the front as the chair 200 inflates. The right support ridge 265 and the upper right support ridge 215 may be spaced to allow for pivoting of the upper right support ridge 215 towards the front as the chair 200 inflates. The space provided between the left support ridge 260 and the upper left support ridge 210 and between the right support ridge 265 and the upper right support ridge 215 take the form of a gap called an upper hinging area (not illustrated in the figures).

In some embodiments, the invention 100 may comprise a headrest 205. The headrest 205 may comprise an elevated area of the seat back 250 at the top of the chair 200. The headrest 205 may be oriented to run from left to right of the inflated chair 110. The headrest 205 may be less than 6 inches high. When inflated, the headrest 205 may extend between 1 inch and 6 inches in front of the plane of the seat back 250.

Some elements of the invention have been described as rectangular and others have been described as L-shaped to present a simple embodiment for the purposes of illustration.

Those skilled in the art will recognize that in some embodiments elements described as rectangular or L-shaped may deviate from those shapes without departing from the spirit and scope of the invention. As a non-limiting example, the upper portion of the left side 220 and the right side 225 may taper as they rise towards the top of the chair 200, causing the seat back 250 to be inclined.

Those skilled in the art will also recognize that although the various elements of the chair 200 have been described as separate pieces, some embodiments may choose to combine elements into a single component that occupies the same location on the chair 200 and provides the same function as the individual elements. As a non-limiting example, the front side 230, the seat 240, the seat back 250, and the top 280 may be combined into a single element that comprises the front side 230, the seat 240, the seat back 250, and the top 280 of the chair 200 and couples to the same elements that the individual elements coupled to. Combining elements as described above may result in lower manufacturing costs.

In use, the deflated chair 120 is spread on the ground 950 next to the supine person 900. The supine person 900 is moved onto the deflated chair 120. As a non-limiting example, the supine person 900 may roll onto the deflated chair 120 or the supine person 900 may pivot onto the deflated chair 120. The motor control 425 may be activated to energize the compressor 400 and the air 920 may start to flow into the chair 200.

If the embodiment comprises some combination of the left support ridge 260, the right support ridge 265, the upper left support ridge 210, and the upper right support ridge 215, they will inflate first and provide an elevated barrier against rolling off of the deflated chair 120. Eventually, the supine person 900 will begin to lift as the chair 200 fills with the air 920. The seat 240 and the seat back 250 will rise at the same rate, forming an elevating plane for the supine person 900 to lay upon. The seat 240 will reach its maximum height, as determined by the geometry of the left side 220, the right side 225, and the front side 230 and will stop rising. However the rear portion of the chair 200 will continue to fill and will begin lifting the supine person 900 into the seated position 910. When the chair 200 is completely filled with the air 920, the person will be sitting upright in the inflated chair 110. The motor control 425 may be used to turn off the compressor 400 and the occupant of the chair 200 may be assisted into a wheelchair or to a standing position.

With no occupant present in the chair 200, the inflated chair 110 may be deflated by moving the reversing control 420 and activating the motor control 425. The compressor 400 will pull the air 920 out of the chair 200 and the chair 200 will collapse back to the deflated chair 120.

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "application" or "app" is software that is specifically designed for use with a personal computing device.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may be construed to mean recharging or replacing individual cells, individual batteries of cells, or a package of multiple battery cells as is appropriate for any given battery technology that may be used. The battery may require electrical contacts, which may not be illustrated in the figures.

Within this disclosure, the word "compressor" refers to a pump that is dedicated to compressing a fluid or placing a fluid under pressure. The fluid being compressed may be gaseous or liquid.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", mean connected, either directly or indirectly and does not necessarily imply a mechanical connection.

As used in this disclosure, an "electric motor" is a device that converts electric energy into rotational mechanical energy.

As used herein, "front" means the side of an object that is closest to a forward direction of travel under normal use of the object or the side or part of an object that normally presents itself to view or that is normally used first. "Rear" or "back' refers to the side that is opposite the front.

As used herein, the word "hose" is intended to include hoses, tubing, piping, and other conduits capable of directing an airflow or a waterflow. When referring to a hose in this disclosure, the terms inner diameter and outer diameter are used as they would be used by those skilled in the plumbing arts.

As used in this disclosure, the word "interior" is used as a relational term that implies that an object is located or contained within the boundary of a structure or a space.

As used in this disclosure, a "motor" refers to a device that transforms energy from an external power source into mechanical energy.

As used in this disclosure, a "pump" is a mechanical device that uses suction or pressure to raise or move fluids, compress fluids, or force a fluid into an inflatable object.

As used in this disclosure, a "ridge" is an elevated or raised portion of a structure.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An inflatable assist chair comprising:

a chair and a compressor;

wherein the chair is inflated using the compressor to form an inflated chair;

wherein the chair is deflated using the compressor to form a deflated chair;

wherein the deflated chair is adapted to be placed under a supine person;

wherein the supine person is adapted to be elevated and repositioned into a seated position when the inflated chair is fully formed;

wherein the chair comprises a rear side, a bottom, a top, a front side, a seat back, a seat, a left side, and a right side;

wherein the chair is an airtight container that is inflated and deflated;

wherein when inflated, the chair expands and changes shape to form the inflated chair;

wherein when deflated, the chair contracts and changes shape to form the deflated chair;

wherein the rear side is a rectangular outer covering on the rear side of the inflated chair;

wherein the rear side is defined by a first edge, a second edge, a third edge, and a fourth edge;

wherein the bottom is a rectangular outer covering on the underside of the inflated chair;

wherein the bottom is defined by a fifth edge, a sixth edge, a seventh edge, and an eighth edge;

wherein the top is a rectangular outer covering on the top side of the inflated chair;

wherein the top is defined by a ninth edge, a tenth edge, an eleventh edge, and a twelfth edge;

wherein the front side is a rectangular outer covering on the underside of the inflated chair;

wherein the front side is defined by a thirteenth edge, a fourteenth edge, a fifteenth edge, and a sixteenth edge;

wherein the seat is a rectangular outer covering on the underside of the inflated chair;

wherein the seat is defined by a twenty-first edge, a twenty-second edge, a twenty-third edge, and a twenty-fourth edge;

wherein the left side is an L-shaped outer covering of the chair located on the left side of the chair;

wherein the left side is defined by a twenty-fifth edge, a twenty-sixth edge, a twenty-seventh edge, a twenty-eighth edge, a twenty-ninth edge, and a thirtieth edge;

wherein the right side is an L-shaped outer covering of the chair located on the right side of the chair;

wherein the right side is defined by a thirty-first edge, a thirty-second edge, a thirty-third edge, a thirty-fourth edge, a thirty-fifth edge, and a thirty-sixth edge.

2. The inflatable assist chair according to claim 1 wherein the outer coverings comprising the chair are coupled at airtight seams;

wherein the first edge on the rear side is coupled to the eleventh edge on the top;

wherein the second edge on the rear side is coupled to the thirtieth edge on the left side;

wherein the third edge on the rear side is coupled to the fifth edge on the bottom;

wherein the fourth edge on the rear side is coupled to the thirty-sixth edge on the right side;

wherein the sixth edge on the bottom is coupled to the twenty-ninth edge on the left side;

wherein the seventh edge on the bottom is coupled to the thirteenth edge on the front side;

wherein the eighth edge on the bottom is coupled to the thirty-fifth edge on the right side;

wherein the ninth edge on the top is coupled to the twenty-third edge on the seat back;

wherein the tenth edge on the top is coupled to the twenty-fifth edge on the left side;

wherein the twelfth edge on the top is coupled to the thirty-first edge on the right side;

wherein the fourteenth edge on the front side is coupled to the twenty-eighth edge on the left side;

wherein the fifteenth edge on the front side is coupled to a seventeenth edge on the seat;

wherein the sixteenth edge on the front side is coupled to the thirty-fourth edge on the right side;

wherein an eighteenth edge on the seat is coupled to the twenty-seventh edge on the left side;

wherein a nineteenth edge on the seat is coupled to the twenty-first edge on the seat back;

wherein a twentieth edge on the seat is coupled to the thirty-third edge on the right side;

wherein the twenty-second edge on the seat back is coupled to the twenty-sixth edge on the left side;

wherein the twenty-fourth edge on the seat back is coupled to the thirty-second edge on the right side.

3. The inflatable assist chair according to claim 2 wherein the compressor comprises an air pump, an electric motor, and a motor control;

wherein the air pump moves air into or out of the chair when turned by the electric motor;

wherein the electric motor is energized by the application of electrical power from a power cord or from one or more batteries;

wherein the compressor moves the air from an inlet of the compressor to an outlet of the compressor when the motor control is in an on position and prevents the flow of the air though the compressor when the motor control is in an off position;

wherein the inlet is coupled to ambient air outside of the chair and the outlet is coupled to the interior of the chair;

wherein when the compressor is activated it increases the pressure inside of the chair, causing the deflated chair to expand and form the inflated chair.

4. The inflatable assist chair according to claim 3 wherein the compressor further comprises a reversing control;

wherein the compressor reverses the flow of the air through the air pump, causing the air to move from the outlet to the inlet.

5. The inflatable assist chair according to claim 4 wherein the compressor is located inside of the chair and is coupled to the bottom on the interior of the chair.

6. The inflatable assist chair according to claim 5 wherein the inlet is coupled to the left side, the right side, the front side, or the rear side and the outlet is located within the interior space of the chair.

7. The inflatable assist chair according to claim 4 wherein the compressor is located outside of the chair.

8. The inflatable assist chair according to claim 7 wherein the outlet is coupled to the chair via an air hose that runs between the outlet and an air hose coupler on the chair.

9. The inflatable assist chair according to claim 4 wherein the chair is fabricated from a flexible, airtight material.

10. The inflatable assist chair according to claim 9 wherein the bottom and the rear side are made from a different material than other parts of the chair.

11. The inflatable assist chair according to claim 9 wherein the chair comprises an internal structure to retain the shape of the inflated chair;

wherein the internal structure comprises internal partial walls or straps running from side-to-side, front-to-back, and/or top-to-bottom;

wherein the internal structure prevents walls of the chair from expanding beyond dimensions established by the internal structure.

12. The inflatable assist chair according to claim 9 wherein the deflated chair is transported by folding the deflated chair in half at the boundary between the rear side and the bottom so that the rear side and the bottom form a protective shell for all other surfaces of the chair, which are tucked between them.

13. The inflatable assist chair according to claim 12 wherein the inflatable assist chair comprises a handle for ease in carrying the deflated chair when folded.

14. The inflatable assist chair according to claim 12 wherein the inflatable assist chair comprises elevated side ridges to prevent the supine person from rolling off the chair as it is inflated;

wherein the chair comprises a left support ridge and a right support ridge;

wherein the left support ridge and the right support ridge are the first parts of the chair to inflate;

wherein the left support ridge comprises an elevated area of the seat on the left side of the chair;

wherein the right support ridge comprises an elevated area of the seat on the right side of the chair;

wherein the left support ridge and the right support ridge are oriented to run from front to rear of the inflated chair;

wherein the left support ridge and the right support ridge each are less than 6 inches wide;

wherein when inflated, the left support ridge and the right support ridge are elevated between 1 inch and 6 inches above the plane of the seat.

15. The inflatable assist chair according to claim 14 wherein the inflatable assist chair comprises an upper left support ridge and an upper right support ridge;

wherein the upper left support ridge comprises an elevated area of the seat back on the left side of the chair;

wherein the upper right support ridge comprises an elevated area of the seat back on the right side of the chair;

wherein the upper left support ridge and the upper right support ridge are oriented to run from top to bottom of the inflated chair;

wherein the upper left support ridge and the upper right support ridge each are less than 6 inches wide;

wherein when inflated, the upper left support ridge and the upper right support ridge each extend between 1 inch and 6 inches in front of the plane of the seat back;

wherein the left support ridge and the upper left support ridge are spaced to allow for pivoting of the upper left support ridge towards the front as the chair inflates;

wherein the right support ridge and the upper right support ridge are spaced to allow for pivoting of the upper right support ridge towards the front as the chair inflates;

wherein the space provided between the left support ridge and the upper left support ridge and between the right support ridge and the upper right support ridge take the form of a gap called an upper hinging area.

16. The inflatable assist chair according to claim 15 wherein the inflatable assist chair comprises a headrest;

wherein the headrest comprises an elevated area of the seat back at the top of the chair;

wherein the headrest is oriented to run from left to right of the inflated chair;

wherein the headrest is less than 6 inches high;

wherein when inflated, the headrest extends between 1 inch and 6 inches in front of the plane of the seat back.

* * * * *